US008915042B2

(12) United States Patent
Ahn et al.

(10) Patent No.: US 8,915,042 B2
(45) Date of Patent: Dec. 23, 2014

(54) STEEL FRAME STRUCTURE USING U-SHAPED COMPOSITE BEAM

(71) Applicants: Tae Sang Ahn, Gunpo-si (KR); Young Joo Kim, Bucheon-si (KR); Dong Woon Jang, Seoul (KR); Seung Ryeol Cha, Seongnam-si (KR); Hoon Kim, Suwon-si (KR); Yong Chan Jung, Namyangju-si (KR); Geum Seok Jeon, Seoul (KR); Dong Beom Song, Seoul (KR); Jae Hoon Bae, Gimpo-si (KR); Jin Won Kim, Seoul (KR); Won gyun Seok, Uiwang-si (KR); Seong Hun Jang, Seoul (KR); Hyeon Su Jeon, Seoul (KR); Jae Seon Hwang, Seoul (KR); Jong Gwon Choi, Seoul (KR); Hong Gi Park, Seoul (KR)

(72) Inventors: Tae Sang Ahn, Gunpo-si (KR); Young Joo Kim, Bucheon-si (KR); Dong Woon Jang, Seoul (KR); Seung Ryeol Cha, Seongnam-si (KR); Hoon Kim, Suwon-si (KR); Yong Chan Jung, Namyangju-si (KR); Geum Seok Jeon, Seoul (KR); Dong Beom Song, Seoul (KR); Jae Hoon Bae, Gimpo-si (KR); Jin Won Kim, Seoul (KR); Won gyun Seok, Uiwang-si (KR); Seong Hun Jang, Seoul (KR); Hyeon Su Jeon, Seoul (KR); Jae Seon Hwang, Seoul (KR); Jong Gwon Choi, Seoul (KR); Hong Gi Park, Seoul (KR)

(73) Assignees: DRB Holding Co., Ltd., Busan (KR); Ssangyoung Engineering & Construction Corporation, Seoul (KR); Dongyang Consulting & Structural Engineers Co., Seoul (KR); KCC Engineering & Construction Co., Ltd., Seoul (KR); Samwoo Space Architects & Engineering Ltd., Gyeonggi-Do (KR); CM Partners Architecture Firm Co., Ltd., Seoul (KR); Firsteceng Co., Ltd., Seoul (KR); Lotte Engineering & Construction, Seoul (KR); Research Institute of Industrial Science & Technology, Kyoungbuk (KR); GS Engineering & Construction, Seoul (KR)

( * ) Notice: Subject to any disclaimer, the term of this patent is extended or adjusted under 35 U.S.C. 154(b) by 0 days.

(21) Appl. No.: 13/870,962

(22) Filed: Apr. 25, 2013

(65) Prior Publication Data

US 2013/0283721 A1 Oct. 31, 2013

(30) Foreign Application Priority Data

Apr. 25, 2012 (KR) ..... 10-2012-0043113
Aug. 20, 2012 (KR) ..... 10-2012-0090946

(51) Int. Cl.
*E04B 1/24* (2006.01)

(52) U.S. Cl.
CPC ..... *E04B 1/24* (2013.01)
USPC ..... 52/649.6; 52/236.6; 52/655.1

(58) Field of Classification Search
CPC ..... E04B 1/24; E04B 1/58; E04B 1/19; E04B 1/26; E04B 2001/2415; E04B 2001/2448; E04B 2001/2457; E04B 2001/405; E04B 7/02; E04C 2/38; E04C 3/02
USPC ..... 52/648.1, 649.1, 649.2, 649.6, 653.1, 52/650.1, 650.3, 702, 837–838, 655.1, 52/656.1, 167.1, 272, 236.3, 236.6, 236.7, 52/831, 289, 252; 403/187, 199, 262; 248/218.4, 219.1, 291.2; 211/189, 211/191–192
See application file for complete search history.

(56) References Cited

U.S. PATENT DOCUMENTS

| | | | | | |
|---|---|---|---|---|---|
| 1,883,376 | A * | 10/1932 | Hilpert et al. | 52/654.1 |
| 4,014,089 | A * | 3/1977 | Sato et al. | 29/525.11 |
| 6,032,431 | A * | 3/2000 | Sugiyama | 52/656.9 |
| 6,073,405 | A * | 6/2000 | Kasai et al. | 52/283 |
| 6,138,427 | A * | 10/2000 | Houghton | 52/655.1 |
| 6,237,303 | B1 * | 5/2001 | Allen et al. | 52/838 |
| 6,266,938 | B1 * | 7/2001 | Sheu et al. | 52/633 |
| 6,474,902 | B1 * | 11/2002 | Beauvoir | 403/403 |
| 6,591,573 | B2 * | 7/2003 | Houghton | 52/656.9 |
| 6,739,099 | B2 * | 5/2004 | Takeuchi et al. | 52/167.1 |
| 7,047,695 | B2 * | 5/2006 | Allen et al. | 52/120 |
| 7,310,920 | B2 * | 12/2007 | Hovey, Jr. | 52/655.1 |
| 7,497,054 | B2 * | 3/2009 | Takeuchi et al. | 52/167.1 |
| 7,637,076 | B2 * | 12/2009 | Vaughn | 52/838 |
| 7,784,226 | B2 * | 8/2010 | Ichikawa et al. | 52/167.1 |
| 8,161,707 | B2 * | 4/2012 | Simmons | 52/648.1 |
| 8,511,033 | B2 * | 8/2013 | Kumakawa et al. | 52/656.9 |
| 2004/0261349 | A1 * | 12/2004 | Hashimoto et al. | 52/633 |
| 2006/0144006 | A1 * | 7/2006 | Suzuki et al. | 52/655.1 |
| 2006/0265992 | A1 * | 11/2006 | Hiragaki | 52/633 |
| 2007/0209314 | A1 * | 9/2007 | Vaughn | 52/720.1 |
| 2007/0261356 | A1 * | 11/2007 | Vaughn | 52/655.1 |
| 2009/0165419 | A1 * | 7/2009 | Richard et al. | 52/650.2 |
| 2009/0223166 | A1 * | 9/2009 | Ohata et al. | 52/699 |
| 2010/0071305 | A1 * | 3/2010 | Collins | 52/704 |

* cited by examiner

*Primary Examiner* — Brian Glessner
*Assistant Examiner* — Beth Stephan
(74) *Attorney, Agent, or Firm* — IPLA P.A.; James E. Bame

(57) ABSTRACT

A steel frame structure includes brackets connected to columns to allow the columns to be connected to a girder. Each bracket includes a U-shaped plate having a bottom plate, side plates extended upwardly perpendicularly from both ends of the bottom plate, and base plates extended outwardly from the side plates, a vertical plate welded perpendicularly to the center of the bottom plate of the U-shaped plate in such a manner as to be parallel to the side plates, and a horizontal plate welded to the top end of the vertical plate in such a manner as to be parallel to the bottom plate of the U-shaped plate. The girder has a generally U-shaped section.

6 Claims, 17 Drawing Sheets

STEEL FRAME STRUCTURE USING U-SHAPED COMPOSITE BEAM

CROSS REFERENCES

Applicants claim foreign priority under Paris Convention to Korean Patent Application No. 10-2012-0043113, filed 25 Apr. 2012, and to Korean Patent Application No. 10-2012-0090946, filed 20 Aug. 2012, each with the Korean Intellectual Property Office, where the entire contents are incorporated herein by reference.

BACKGROUND OF THE INVENTION

The present invention relates to a steel frame structure, and more particularly, to a steel frame structure using U-shaped composite beams that is capable of improving the constructability and structural performance in the connected portions between columns and girders and between the girders and beams.

A steel frame structure (or a steel structure) and a steel frame structured reinforced concrete structure are representative examples of modern construction methods, and they are applied to a wide range of constructions from warehouses having a relatively simple structure to high-rise buildings, hangar decks, gymnasiums, airports, and factories requiring large-sized space. The steel frame structure has a variety of structural shapes in accordance with its size and purpose and accordingly adopts different materials and connecting methods in response to its structural shapes. Examples of the steel frame structure are a frame structure, a truss structure, a gable frame, a steel pipe structure, and a light weight steel frame structure.

The frame structure of the steel frame structure is made by forming a lattice type frame structure with all kinds of columns and beams. In this case, slabs or horizontal braces are used as side-force reinforcing parts, and shear walls are appropriately arranged. The frame structure is popularized in recent high-rise buildings as well as medium or less-rise buildings because of its structural simplicity and the easiness in the construction thereof.

Structural members constituting the frame structure are columns, beams, and slabs, and the beams include steel beams, built-up beams, lattice beams, honeycomb beams, and composite beams with concrete.

One of the prior art is disclosed in Korean Patent No. 0617878 entitled "molded steel plate concrete beam". The conventional molded steel plate concrete beam includes a U-shaped permanent mold made by integrating two L-shaped steel plates with each other by means of welding, and the U-shaped permanent mold has top flanges, bottom flanges and web plates. Shear connectors are attached to the top flanges in such a manner as to be integrated with slab concrete, and the bottom flanges have a Y-shaped protrusion formed on the center portion thereof to increase the section and the composition effects of the concrete cast in the interior thereof, so that the concrete is cast into the U-shaped permanent mold to allow the U-shaped permanent mold to be integrated with an external permanent mold plate.

According to the above-mentioned prior art, however, the two L-shaped steel plates are integrated as a unitary body by means of the welding, so that the whole shape becomes complicated, and bending, cutting and welding for making the structure are needed, thereby making it hard to manufacturing the structure. Since the molded steel plate concrete beam is different from existing steel beams, further, the connecting way between columns and beams are different from that in the existing steel structure, so that the molded steel plate concrete beam does not make use of the existing steel structure connecting way like existing bracket type beam connection.

Another example of the prior art is disclosed in Korean Utility Model Registration No. 0420294 entitled "asymmetric H-shaped beam". The asymmetric H-shaped beam includes top and bottom flanges having different widths from each other and a web formed vertically between the top and bottom flanges, the web having at least one or more through-holes formed thereon, through which wire members are passed.

In the above-mentioned another example of the prior art, however, the top flange is formed over the whole length of the web even in the region where positive moment action is generated, so that the quantity of steel materials consumed is increased to cause high production costs, and the whole self-weight of the beam is also increased. Further, the web has the through holes for improving the composition effects, so that the shape of the section of the web becomes complicated and the cutting processes are increased during manufacturing to cause high production costs and construction costs.

Yet another example of the prior art is disclosed in Korean Patent No. 0851490 entitled "steel composite beam structure for saving story height". The steel composite beam structure includes I-shaped steel beams having webs, top flanges, and bottom flanges, the bottom flanges having the widths larger than the top flanges and the webs having web holes formed on the center thereof in such a manner as to be spaced apart from each other by a given distance in the state of being far from the top flanges and the bottom flanges. Further, the bottom flanges have ¬-shaped support plates extended from both ends thereof along the direction of the length of the steel beams, and a deck plate mounted on the ¬-shaped support plates, onto which slab concrete is cast. The web holes have a trapezoidal shape having the upper base side being shorter in length than the lower base, and the ¬-shaped support plates are coupled to both ends of the bottom flanges by means of seam welding or are integrated with the bottom flanges. The steel beams are divided into the girder having a long depth and the beam having a short depth, and when the girder and the beam are connected to each other at a given angle, the ¬-shaped support plate of the beam is mounted on the ¬-shaped support plate of the girder. Also, the web holes of the girder are positioned between the top surface of the ¬-shaped support plate of the beam and the top surface of ¬-shaped support plate of the girder in such a manner as to allow a duct to be passed therethrough.

In the above-mentioned yet another example of the prior art, however, the top flanges are formed over the whole lengths of the webs, so that the quantity of steel materials consumed is increased to cause high production costs, and further, the web holes are formed on the webs to obtain the composition effects, so that the shapes of the sections of the webs become complicated and the cutting processes are increased during manufacturing to cause high production costs and construction costs. Additionally, the beam is mounted on the top of the girder, so that it is hard to perform the construction, and since the sectional shapes and depths between the girder and the beam are different from each other, the connecting way between column and beam is different from that in existing steel structure, so that the steel composite beam structure does not make use of the existing steel structure connecting way like existing bracket type beam connection.

SUMMARY OF THE INVENTION

Accordingly, the present invention has been made in view of the above-mentioned problems occurring in the prior art, and it is an object of the present invention to provide a steel frame structure that is capable of removing various problems caused by the complication of conventional composite beam manufacturing, the increment of the manufacturing costs, the complication of the construction of the connected portions between columns and a girder and between the girder and beams, and the structural inefficiencies.

To accomplish the above objects, according to a first aspect of the present invention, there is provided a steel frame structure having columns, a girder connected between the columns, and beams connected to the girder, the steel frame structure including: brackets connected to each column to allow the column to be connected to the girder, each bracket including a U-shaped plate having a bottom plate, side plates extended upwardly perpendicularly from both ends of the bottom plate, and base plates extended outwardly from the side plates, a vertical plate welded perpendicularly to the center of the bottom plate of the U-shaped plate in such a manner as to be parallel to the side plates, and a horizontal plate welded to the top end of the vertical plate in such a manner as to be parallel to the bottom plate of the U-shaped plate; the girder having a generally U-shaped section and including a central web plate and a top flange plate connected to both ends thereof in such a manner as to be connected to the brackets, interval maintaining members spaced apart from each other by a given distance over the whole length of the top surface thereof, and beam connectors connected thereto at positions to which the beams are connected; and each beam having a bottom flange plate, side web plates extended upwardly perpendicularly from both ends of the bottom flange plate, and mounting plates extended outwardly from one ends of the side web plates in such a manner as to be parallel to the bottom flange plate, each beam being adapted to be connected to the girder through the beam connectors and further having interval maintaining members spaced apart from each other by a given distance over the whole length of the top surface thereof, whereby concrete is filled into the girder and the beams.

According to the present invention, preferably, the center portion of the girder is composed of a bottom flange plate, side web plates extended upwardly perpendicularly from both ends of the bottom flange plate, and mounting plates extended outwardly from the side web plates in such a manner as to be parallel to the bottom flange plate, and the end portion of the girder is composed of the center web plate connected vertically to the center of the bottom flange plate and the top flange plate connected to the top end of the center web plate in such a manner as to be parallel to the bottom flange plate.

According to the present invention, preferably, each bracket has the side plates shorter in length than the vertical plate, thereby forming first openings, and the girder has the side web plates and the mounting plates incised from the end portion of the bottom flange plate to a position distant by a given length toward the center portion thereof, thereby forming second openings, whereby the girder is connected to the bracket through the first openings and the second openings, and the first openings and the second openings are closed by means of opening closure members.

According to the present invention, preferably, each opening closure member includes a bottom plate serving as a cover plate adapted to connect the bottom flange plate of the girder and the base plate of the bracket with each other over their top portions, a side plate extended upwardly perpendicularly from one end of the bottom plate in such a manner as to close the first openings and the second openings, and a top plate extended outwardly horizontally from one end of the side plate.

According to the present invention, preferably, the interval maintaining members include angles or channels.

According to the present invention, preferably, each beam connector includes both side plates spaced apart from each other and a connecting plate connecting the lower ends of the both side plates, thereby having a generally U-shaped section, the heights of the both side plates being the same as the side web plates, and the distance between the both side plates being formed to insert the beam thereinto, and the girder at the position connected to the beam connectors includes stiffeners mounted between the side web plates on the same line as the both side plates of the beam connectors.

To accomplish the above objects, according to a second aspect of the present invention, there is provided a steel frame structure having columns, a girder connected between the columns, and beams connected to the girder, the steel frame structure including: brackets connected to each column to allow the column to be connected to the girder; the girder having a generally U-shaped section and having a connecting member having end portions protruded from both ends thereof in such a manner as to be connected to the brackets, the connecting member having a center web plate and top and bottom flange plates formed on the top and bottom of the center web plate, interval maintaining members spaced apart from each other by a given distance over the whole length of the top surface thereof, and beam connectors connected thereto at positions to which the beams are connected; each beam having the same depth as the girder and having a bottom flange plate, side web plates extended upwardly perpendicularly from both ends of the bottom flange plate, and mounting plates extended outwardly from one ends of the side web plates in such a manner as to be parallel to the bottom flange plate, each beam being adapted to be connected to the girder through the beam connectors and further having interval maintaining members spaced apart from each other by a given distance over the whole length of the top surface thereof; and a covering member having a top plate covered over the top portions of the top flange plate of the girder and the top flange of the bracket, side plates extended downwardly perpendicularly from both ends of the top plate, and a bottom plate extended outwardly horizontally from one ends of the side plates to the height parallel to the mounting plates of the girder, whereby concrete is filled into the girder and the beams.

According to the present invention, preferably, the center portion of the girder is composed of a bottom flange plate, side web plates extended upwardly perpendicularly from both ends of the bottom flange plate, and mounting plates extended outwardly from the side web plates in such a manner as to be parallel to the bottom flange plate.

According to the present invention, preferably, each bracket has the same sectional shape as the girder and includes a top flange, a web formed vertically at the center of the top flange, and a bottom flange formed on the underside of the web in such a manner as to be parallel to the top flange.

According to the present invention, preferably, the covering member has an opening penetrated into the top plate.

According to the present invention, preferably, each bracket has a T-shaped section made by cutting the web plate of the H-shaped beam and includes a flange and a web plate, the web plate being coupled to the column and the flange being coupled to the end portion of the girder.

According to the present invention, preferably, the interval maintaining members include angles or channels.

According to the present invention, preferably, each beam connector includes both side plates spaced apart from each other and a connecting plate connecting the lower ends of the both side plates, thereby having a generally U-shaped section, the heights of the both side plates being the same as the side web plates, and the distance between the both side plates being formed to insert the beam thereinto, and the girder at the position connected to the beam connectors comprises stiffeners mounted between the side web plates on the same line as the both side plates of the beam connectors.

According to the present invention, the U-shaped composite girder and beams can be simply made just by bending single steel plates at a room temperature, thereby reducing the manufacturing costs and the story height. Further, the construction of the connected portions between columns and girder and between the girder and beams can be made in a simple manner and the structural stability can be ensured. Especially, the construction of the connected portion between the column and the girder can be performed without having any interference of the side plates for the concrete casting in the interior of the girder. Additionally, the girder and the beam have the same depth as each other, and the connection between the girder and the beam can be stably performed by means of the beam connectors coupled to the sides of the girder.

BRIEF DESCRIPTION OF THE DRAWINGS

FIGS. 3*a* to 3*c* show a girder adopted in the steel frame structure according to the first embodiment of the present invention, wherein FIG. 3*a* is a perspective view thereof, FIG. 3*b* is a sectional view of the center portion thereof, and FIG. 3*c* is a sectional view of the end portion thereof.

FIGS. 9*a* to 9*d* show a girder adopted in the steel frame structure according to the second embodiment of the present invention, wherein FIG. 9*a* is a perspective view thereof, FIG. 9*b* is a sectional view of the center portion thereof, FIG. 9*c* is a sectional view of the connected portion thereof, and FIG. 9*d* is a sectional view of the end portion thereof.

FIGS. 12*a* and 12*b* are exploded perspective views showing the connected portion between the bracket and the girder in the steel frame structure according to the second embodiment of the present invention, wherein FIG. 12*a* shows an H-shaped bracket and FIG. 12*b* a CT-shaped bracket.

DETAILED DESCRIPTION OF THE INVENTION

Figure 1:
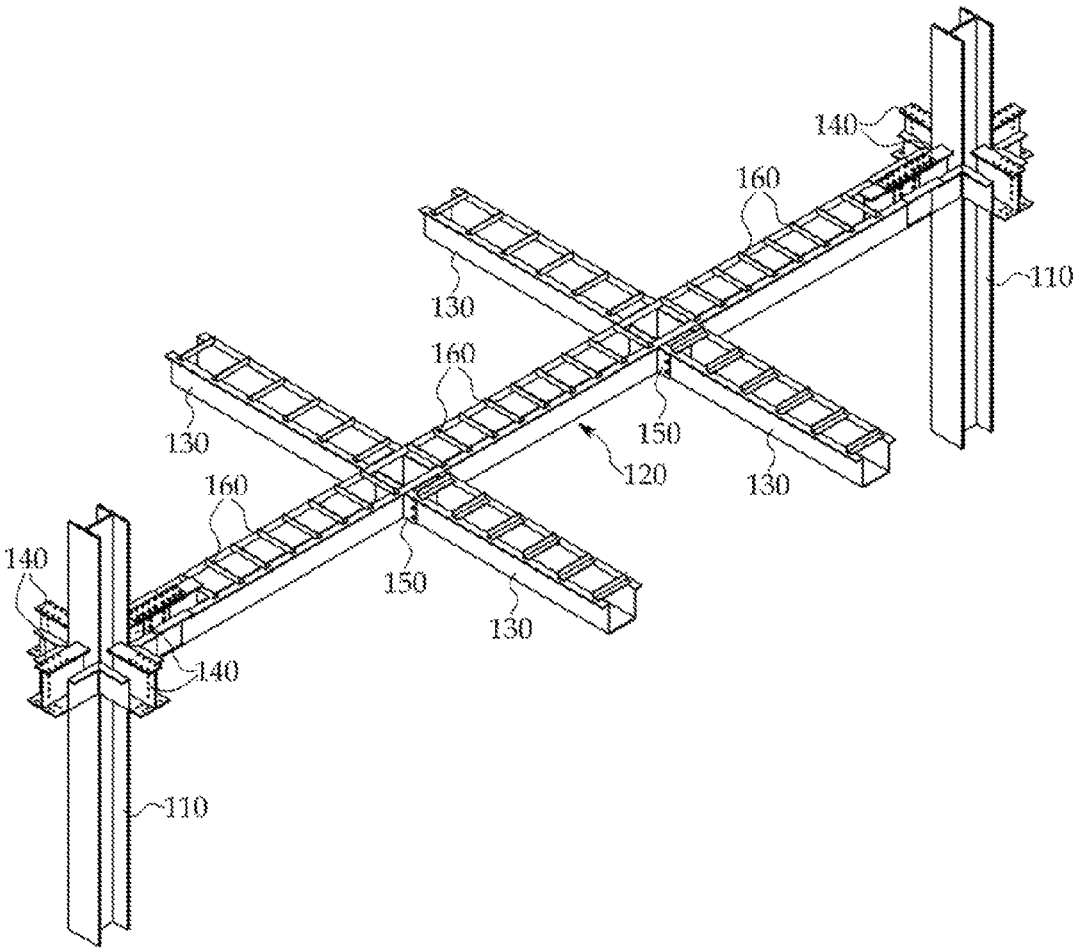
FIG. 1 is a perspective view showing a steel frame structure according to a first embodiment of the present invention.

Hereinafter, an explanation on a steel frame structure according to the preferred embodiments of the present invention will be in detail given with reference to the attached drawings. The present invention will be described just with illustrative embodiments for the clear understanding of the present invention, and therefore, the present invention is not limited to them.

According to the preferred embodiments of the present invention, the steel frame structure is configured wherein girders 120 and beams 130 are formed by U-shaped composite beams and the connection between a column 110 and each girder 120 is formed by brackets 140 or 240. Further, a connecting member for coupling the end portion of the girder 120 and the brackets 140 or 240 is formed by opening closure members 170 in a first embodiment of the present invention and by a covering member 270 in a second embodiment of the present invention.

Hereinafter, the first and second embodiments of the present invention will be in detail described. FIGS. 1 to 7*d* show the steel frame structure according to the first embodiment of the present invention.

As shown in FIG. 1, the steel frame structure according to the first embodiment of the present invention largely includes columns 110, a girder 120 connected between the columns 110, and beams 130 connected to the girder 120.

Since the columns 110 are under a substantially large compression force, they should have a cross section having a relatively large size. In the drawings, the columns 110 are used as structural steel having an H-shaped section, that is, H-shaped beams, but the present invention is not limited thereto. Accordingly, the columns 110 may be used as square steel pipes that have constant sectional performance in accordance with the direction of the application of a force thereto, even if it is hard to machine the connected portion with the girder.

In case of the H-shaped beams, it is easy to machine the connected portion between the column and the girder, and thus, they are most widely used. Because the H-shaped beam has a standard size of a length of 10 m, the H-shaped beam for two to three stories is generally made as a single unit. Unlike the square steel pipes, the H-shaped beams have different sectional performance in accordance with the direction of the application of a force thereto, and therefore, the webs of the H-shaped beams are disposed parallel to the direction of the long side of the span, as shown.

Each H-shaped column 110 has brackets 140 connected thereto to allow the connection with the girder 120. In case of the column located at the center on the plane, the brackets 140 are connected to both side flanges and both sides of the web thereof, as shown in the drawings, and in case of the column located at the corner, they are connected to one side flange and one side of the web thereof. In case of the column located at the outside, the brackets 140 are connected to both side flanges and one side of the web thereof.

Figure 2:
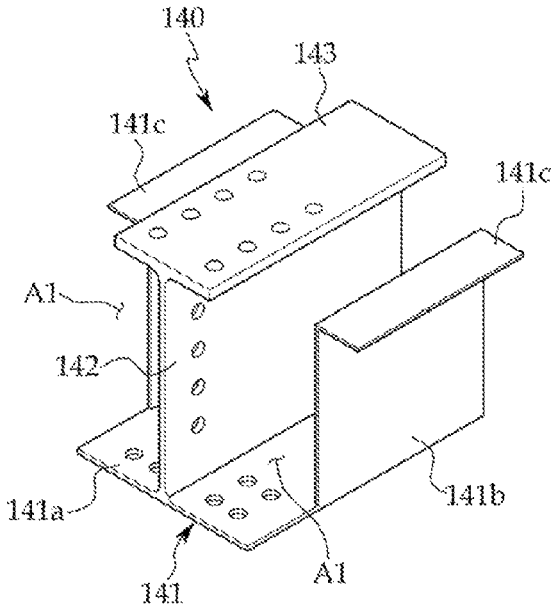
FIG. 2 is a perspective view showing a bracket adopted in the steel frame structure according to the first embodiment of the present invention.

As shown in FIG. 2, each bracket 140 is composed of a U-shaped plate 141, a vertical plate 142 and a horizontal plate 143. The U-shaped plate 141 includes a bottom plate 141*a*, side plates 141*b* extended upwardly perpendicularly from both ends of the bottom plate 141*a*, and base plates 141*c* extended outwardly from the side plates 141*b*, and they are integrally formed by bending a thin plate at a room temperature. The vertical plate 142 is welded perpendicularly to the center of the bottom plate 141*a* of the U-shaped plate 141 in such a manner as to be parallel to the side plates 141*b*, and the horizontal plate 143 is welded to the top end of the vertical plate 142 in such a manner as to be parallel to the bottom plate 141*a* of the U-shaped plate 141. At this time, the width of the bottom plate 141*a* is larger than that of the horizontal plate 143, and the height of the vertical plate 142 is higher than that of the side plates 141*b*.

The bottom plate 141*a* of the U-shaped plate 141, the vertical plate 142 and the horizontal plate 143 have the same length as each other and H-shaped sections, and as will be described later, they serve to provide the connection between the girder and the column, which is the same as the existing connection between the H-shaped column and H-shaped beam. The side plates 141*b* of the U-shaped plate 141 serve as the mold for concrete casting, and the base plates 141*c* serve as the base surface on which the mold is located for the concrete casting of slab like a deck plate. On the other hand, the length of each side plate 141*b* is shorter than that of the vertical plate 142, thereby forming first openings A1 needed when the bracket 140 is connected to the girder 120, which will be described later.

Figure 3A:
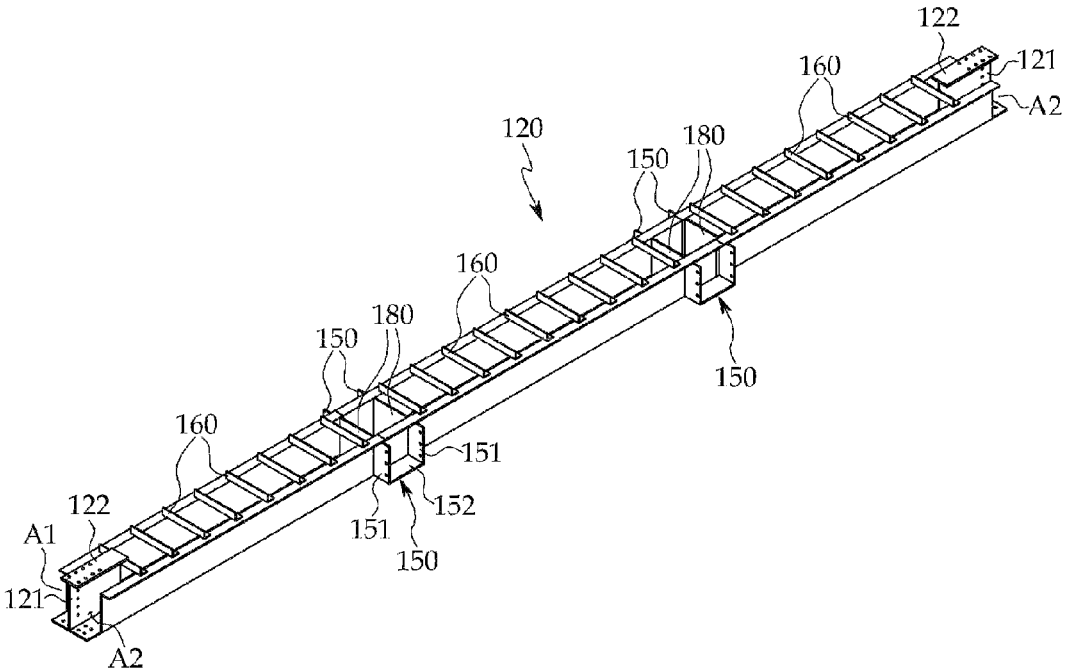

As shown in FIG. 3*a*, the girder 120 connected between the columns 110 has a generally U-shaped section and has a central web plate 121 and a top flange plate 122 connected to both ends thereof in such a manner as to be connected to the brackets 140. Further, the girder 120 includes interval maintaining members 160 spaced apart from each other by a given distance over the whole length of the top surface thereof and beam connectors 150 connected thereto at positions to which the beams 130 are connected.

The girder 120 is formed by bending a thin steel plate at a room temperature in the same manner as the bracket 140 and has different shapes between the center portion corresponding to the positive moment region and the end portion corresponding to the negative moment region so as to achieve the effective use of the section and the easy connection with the column.

Figure 3B:
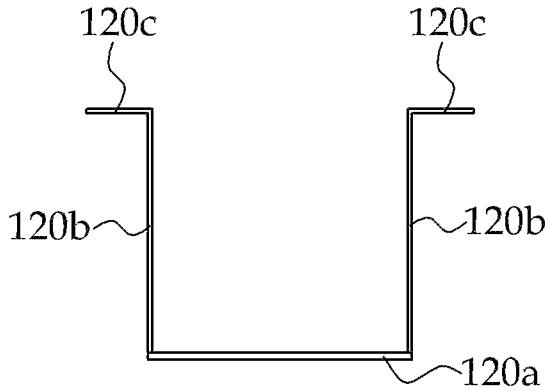

As shown in FIG. 3*b*, the center portion of the girder 120 is composed of a bottom flange plate 120*a*, side web plates 120*b*, and mounting plates 120*c*. The side web plates 120*b* are extended upwardly perpendicularly from both ends of the bottom flange plate 120*a*, and the mounting plates 120*c* are extended outwardly from the side web plates 120*b* in such a manner as to be parallel to the bottom flange plate 120*a*.

Figure 3C:
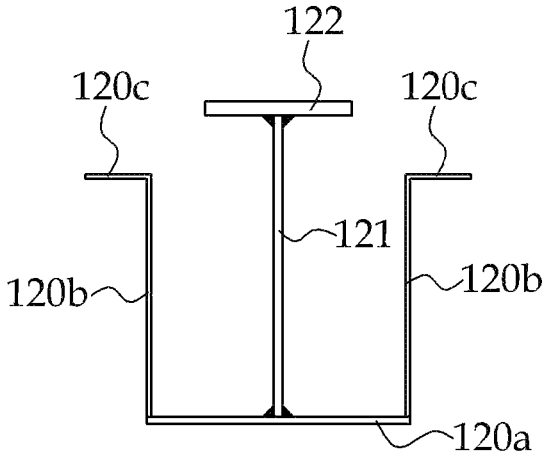

As shown in FIG. 3*c*, the end portion of the girder 120 is composed of a center web plate 121 connected vertically to the center of the bottom flange plate 120*a* and a top flange plate 122 connected to the top end of the center web plate 121 in such a manner as to be parallel to the bottom flange plate 120*a*. At this time, the side web plates 120*b* and the mounting plates 120*c* are incised from the end portion of the bottom flange plate 120*a* to a position distant by a given length toward the center portion thereof, thereby forming second openings A2 through which the access to the center web plate 121 from the outside of the girder 120 is performed.

Figure 4:
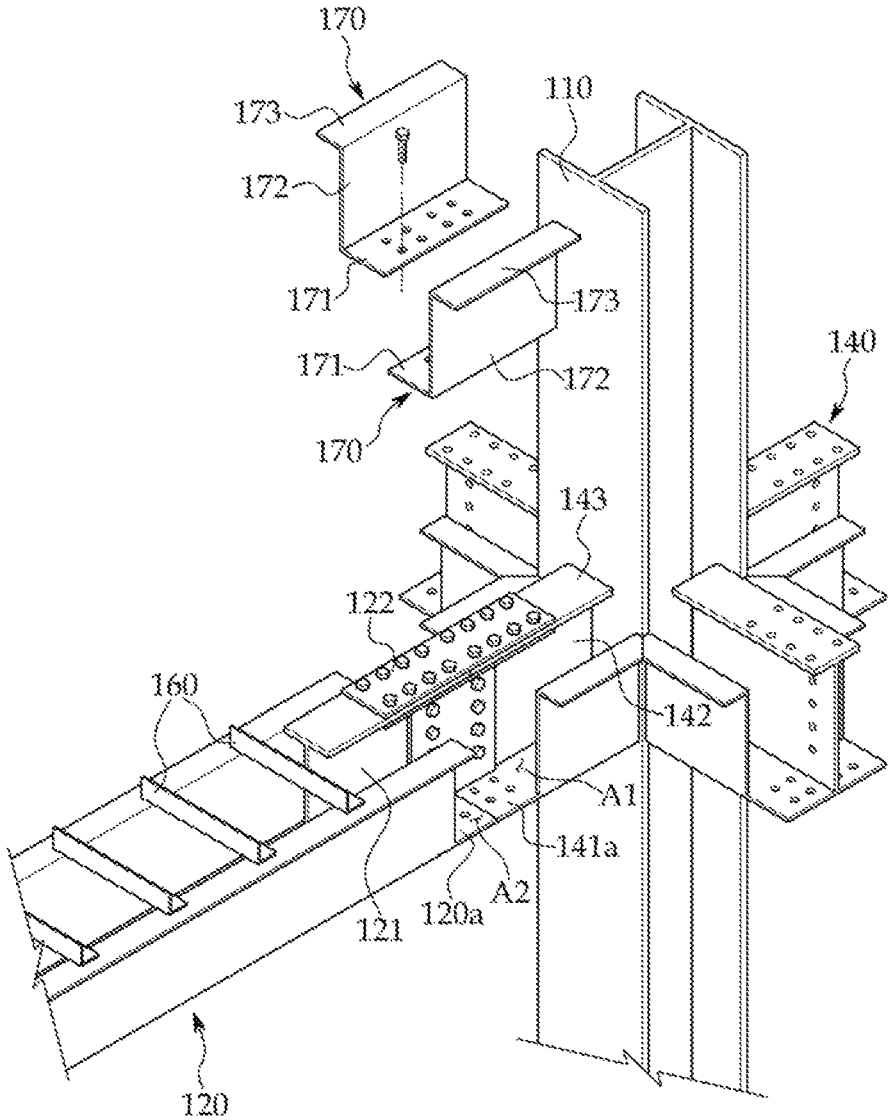
FIG. 4 is an exploded perspective view showing the connected portion between the bracket and the girder in the steel frame structure according to the first embodiment of the present invention.

Accordingly, as shown in FIG. 4, the first and second openings A1 and A2 are formed on the connected portion between the girder 120 and the bracket 140, and further, opening closure members 170 are mounted to close the first and second openings A1 and A2. Each opening closure member 170 is composed of a bottom plate 171, a side plate 172 extended upwardly perpendicularly from one end of the bottom plate 171, and a top plate 173 extended outwardly horizontally from one end of the side plate 172, thereby having a generally Z-shaped section. The bottom plate 171 serves as a cover plate adapted to connect the bottom flange plate 120*a* of the girder 120 and the base plate 141*a* of the bracket 130 with each other over their top portions, and the side plate 172 closes the first and second openings A1 and A2. The top plate 173 supplies the mounting surface of the deck plate.

The girder 120 and the bracket 140 are rigidly connected to each other by means of cover plates. Through the cover plates, that is, the top flange plate 122 of the girder 120 is connected to the horizontal plate 143 of the bracket 140, the center web plate 121 of the girder 120 to the vertical plate 142 of the bracket 140, and the bottom flange plate 120*a* of the girder 120 to the bottom plate 141*a* of the bracket 140. At this time, as mentioned above, the first and second openings A1 and A2 are formed on the connected portion between the girder 120 and the bracket 140, and therefore, through the first and second openings A1 and A2, the center web plate 121 of the girder 120 is connected to the vertical plate 142 of the bracket 140 by means of the cover plate. Next, the opening closure member 170 is mounted, and through the opening closure member 170, the bottom flange plate 120*a* of the girder 120 is connected to the bottom plate 141*a* of the bracket 140 by means of the cover plate. According to the present invention, therefore, the connection process between the column 110 and the girder 120 can be performed without any interference of the side plates 141*b* of the bracket 140 and the side web plates 120*b* of the girder 120 forming the concrete casting space, in the same manner as the existing construction of the connected portion between the H-column and beam.

The interior of the girder 120, that is, the space enclosed by the bottom flange plate 120*a* and the side web plates 120*b* is filled with concrete, and so as to maintain the shape during construction and to prevent the side web plates 120*b* from opening during the concrete casting, therefore, the interval maintaining members 160 are mounted on the girder 120. The interval maintaining members 160 are spaced apart from each other by a given distance over the whole length of the girder 120 in a direction perpendicular to the direction of the length of the girder 120 thereof in such a manner as to connect the mounting plates 120*c* to each other. In the figures, the interval maintaining members 160 are formed of L-shaped steel (that is, angles), but they are not limited thereto. That is, they may be formed of members having the strength capable of preventing the opening of the side web plates 120*b* and an arbitrary sectional shape well known to the art, for example, ⊏-shaped steel (channels), Z-shaped steel and the like. On the other hand, the interval maintaining members 160 also serve as shear connectors inducing the composition of the slab concrete and the girder 120 as different materials.

The beams 130 are connected to the girder 120 in a perpendicular direction to the direction of the length of the girder 120. In the figures, two beams 130 are connected to one side of the girder 120, so that four beams 130 are connected to both sides of the girder 120, but the number of beams connected to the girder 120 is not limited thereto. Therefore, the number of beams connected to the girder 120 is determined upon the length of the girder 120.

Figure 5:
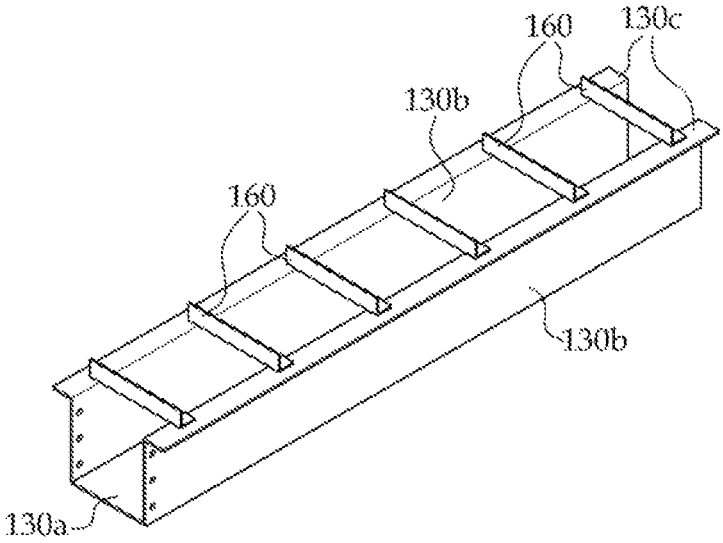
FIG. 5 is a perspective view showing a beam adopted in the steel frame structure according to the first embodiment of the present invention.

The beams 130 are made in the same manner as the girder 120 and have the same sectional shape as the center portion of the girder 120. That is, as shown in FIG. 5, each beam 130 includes a bottom flange plate 130*a*, side web plates 130*b*, and mounting plates 130*c*. The side web plates 130*b* are extended upwardly perpendicularly from both ends of the bottom flange plate 130*a*, and the mounting plates 130*c* are extended outwardly from one ends of the side web plates 130*b* in such a manner as to be parallel to the bottom flange plate 130*a*. In the same manner as the girder 120, further, the interval maintaining members 160 are spaced apart from each other by a given distance over the whole length of the beam 130 to prevent the side web plates 130*b* from opening during the construction and the concrete casting.

Figure 6:
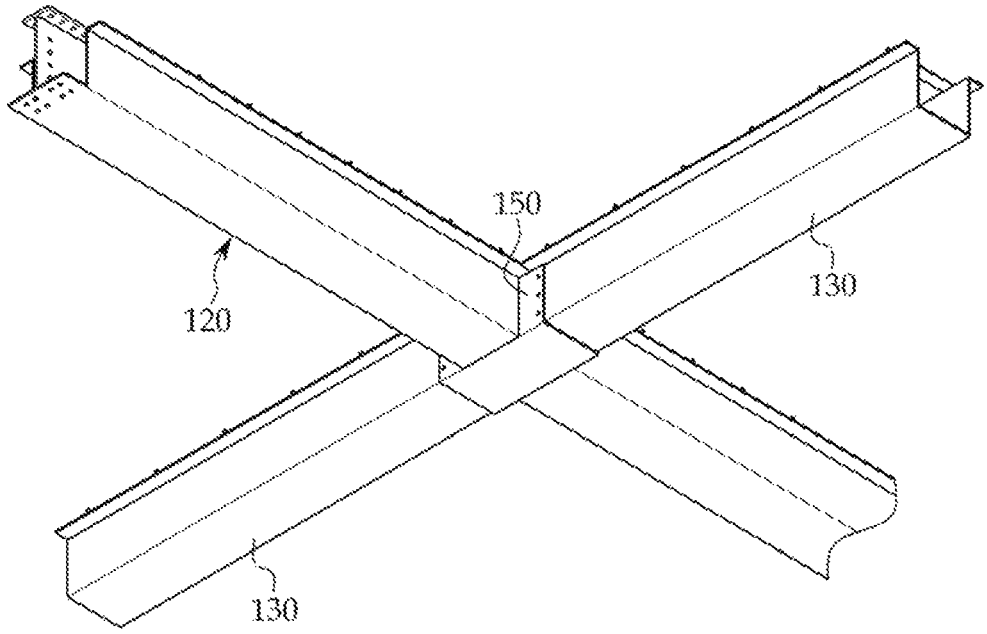
FIG. 6 is a bottom perspective view showing the connected portion between the girder and the beam in the steel frame structure according to the first embodiment of the present invention.

The beams 130 have the same beam depth as the girder 120 and are connected to the girder 120 by means of beam connectors 150. Each beam connector 150 has both side plates 151 spaced apart from each other and a connecting plate 152 connecting the lower ends of the both side plates 151, thereby having a generally U-shaped section. The heights of the both side plates 151 are the same as the side web plates 120*b*, and the distance between the both side plates 151 is formed to insert the beam 130 thereinto. Accordingly, as shown in FIG. 6, the beams 130 are inserted between the both side plates 151 of the beam connectors 150 and supported by means of the connecting plates 152. In this state, bolts are fastened to the beams 130, and as a result, the girder 120 and the beams 130 are connected to each other in simple and rigid manners.

On the other hand, the girder 120 has stiffeners 180 mounted between the side web plates 120*b* at the position connected to the beam connectors 150 on the same line as the both side plates 151 of the beam connectors 150, thereby preventing the buckling of the girder 120.

Under the above-mentioned configuration of the steel frame structure according to the present invention, the components are previously made in a plant and then carried and constructed just by means of bolt connection in a construction site, in the same manner as the existing steel frame structure construction method.

In more detail, the columns 110, the girder 120, the beams 130, the brackets 140, the beam connectors 150, the interval maintaining members 160, and the opening closure members 170 are made in a plant. Next, the brackets 140 are connected to the columns 110 by means of welding, and the interval maintaining members 160, the beam connectors 150 and the stiffeners 180 are to the girder 120 by means of welding.

After that, they are delivered to the construction site and assembled to each other. That is, the columns 110 to which the brackets 140 are connected are erected (see FIG. 7*a*), and the girder 120 is connected between the columns 110 through the brackets 140 (see FIG. 7*b*). At this time, the opening closure members 170 are mounted to close the first and second openings A1 and A2 formed between the girder 120 and the brackets 140. Lastly, the beams 130 are connected to the girder 120 by means of the beam connectors 150 (see FIG. 7*c*).

Figure 7A:
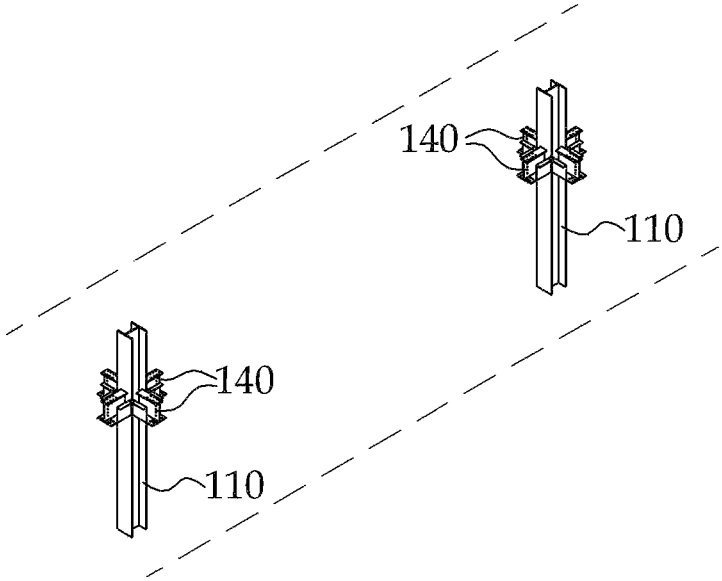
FIGS. 7*a* to 7*d* are perspective views showing a construction method of the steel frame structure according to the first embodiment of the present invention.
Figure 7B:
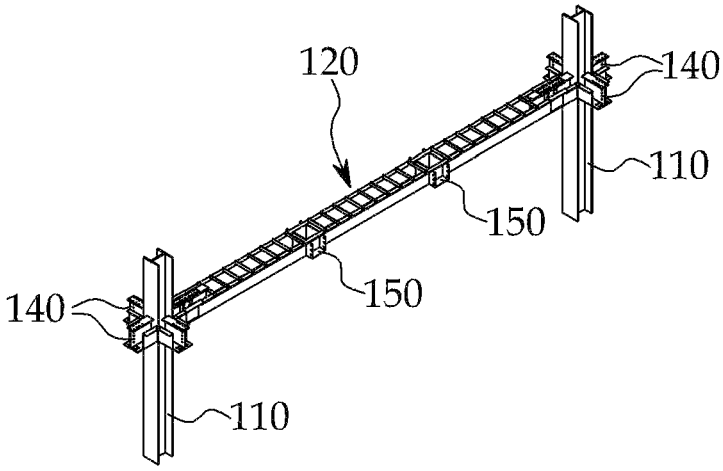
Figure 7C:
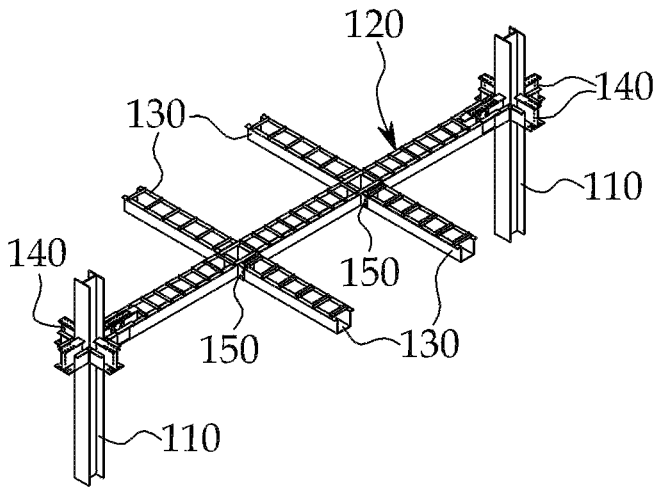
Figure 7D:
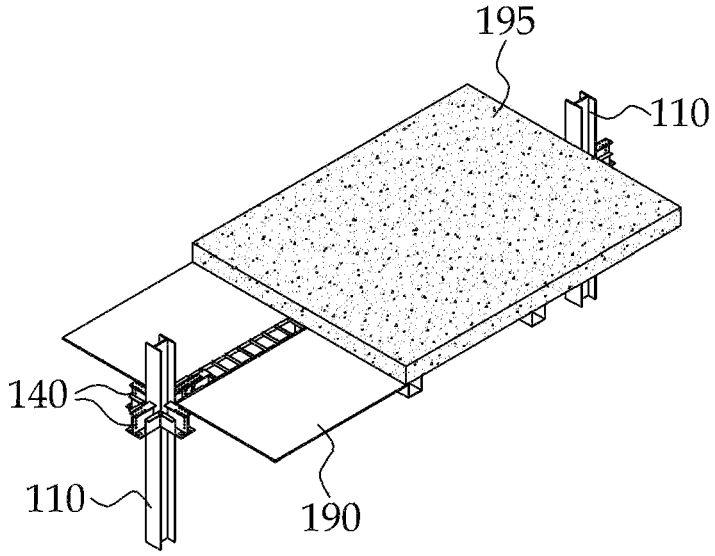

On the girder 120 and the beams 130 of the steel frame structure formed with the above-mentioned configuration, a deck plate 190 is mounted to cast slab concrete 195 thereon (see FIG. 7*d*). At the time of the slab concrete casting, the concrete is filled into the girder 120 and the brackets 140. Accordingly, the girder 120 and the beams 130 according to the present invention become the composite girder and beam made by integrating the steel and the concrete.

On the other hand, the columns 110 are formed of steel columns in the first embodiment of the present invention, but they may be formed of steel framed reinforced concrete columns made by coating the steel column with concrete. In this case, the connecting method of the columns 110 and the girder 120 are the same as the steel columns, but before the slab concrete casting, column bars are arranged. Next, the column molds are formed, and then, the column concrete casting is performed together with the slab concrete casting.

FIGS. 8 to 14*d* show the steel frame structure according to the second embodiment of the present invention.

Figure 8:
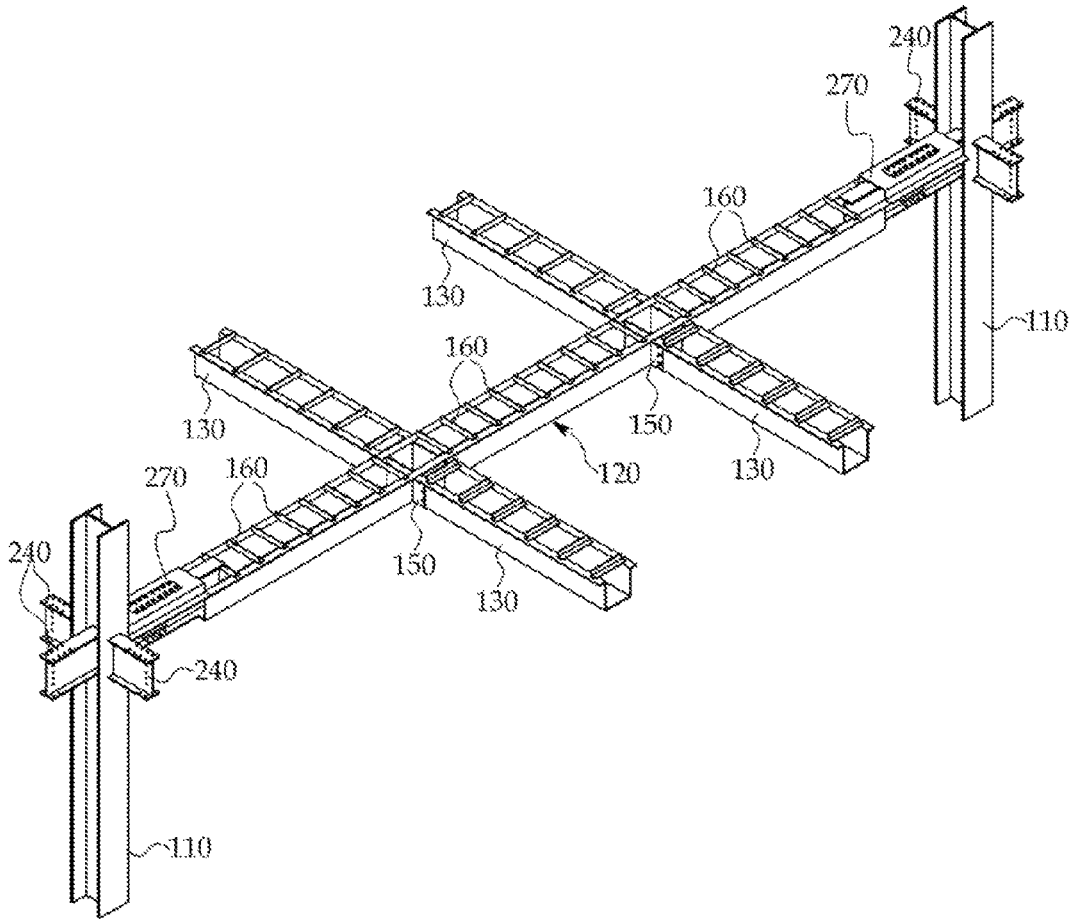
FIG. 8 is a perspective view showing a steel frame structure according to a second embodiment of the present invention.

FIG. 8 is a perspective view showing a steel frame structure according to the second embodiment of the present invention, and as shown in FIG. 8, the steel frame structure according to the second embodiment of the present invention largely includes columns 110, a girder 120 connected between the columns 110, and beams 130 connected to the girder 120. Further, brackets 240 are connected to each column 110 to perform the connection with the girder 120, and cover members 270 are covered on the top portions of the connection portions between the end portions of the girder 120 and the brackets 240.

Figure 9A:
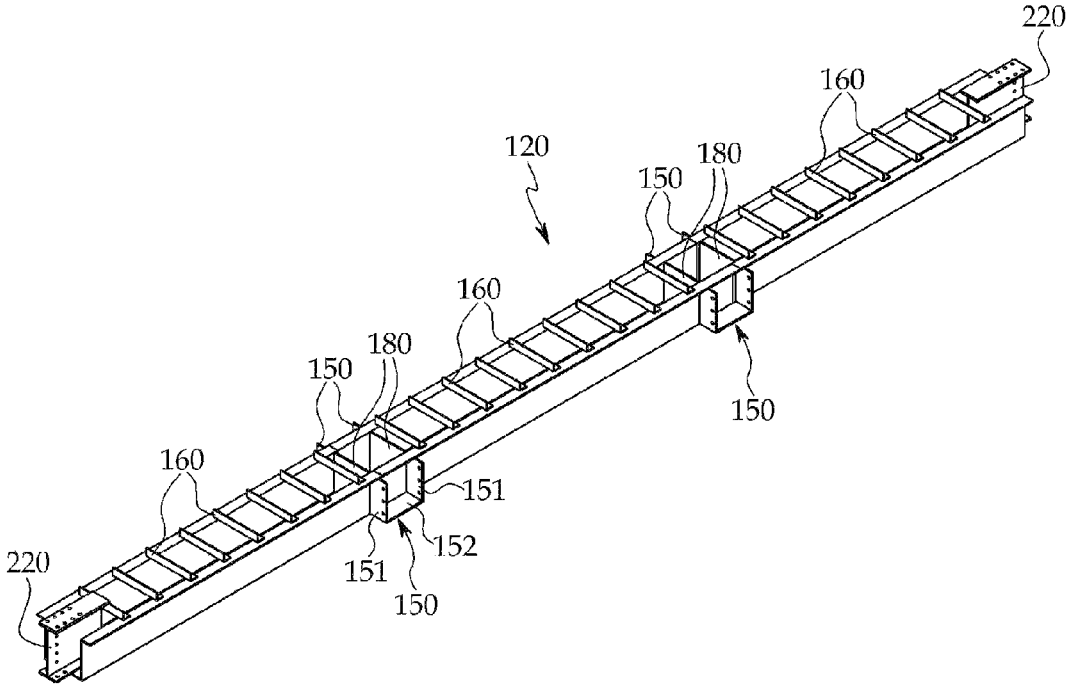
Figure 9B:
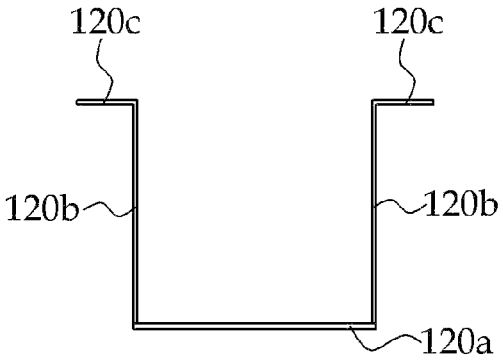
Figure 9C:
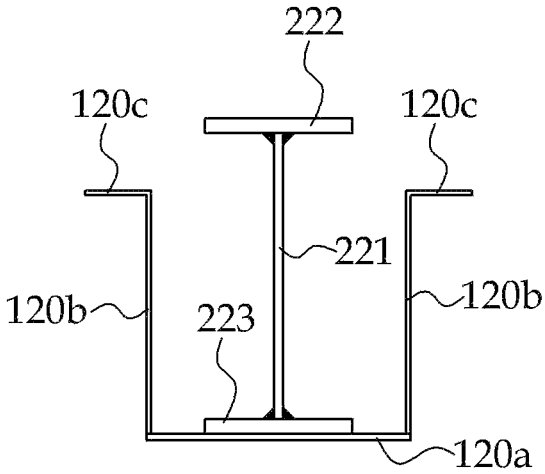
Figure 9D:
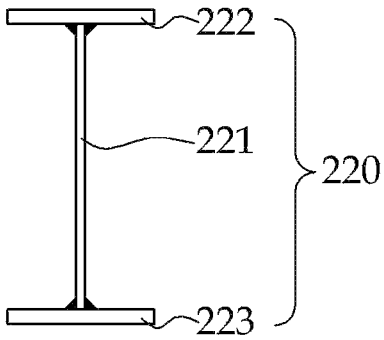

FIGS. 9*a* to 9*d* show the girder adopted in the steel frame structure according to the second embodiment of the present invention, wherein FIG. 9*a* is a perspective view thereof, FIG. 9*b* is a sectional view of the center portion thereof, FIG. 9*c* is a sectional view of the connected portion thereof, and FIG. 9*d* is a sectional view of the end portion thereof.

As shown in FIG. 9*a*, the girder 120 connected between the columns 110 has a generally U-shaped section and has a connecting member 220 having end portions protruded from both ends thereof in such a manner as to be connected to the brackets 140.

Further, the girder 120 includes interval maintaining members 160 spaced apart from each other by a given distance over the whole length of the top surface thereof and beam connectors 150 connected thereto at positions to which the beams 130 are connected.

The girder 120 is formed by bending a thin steel plate at a room temperature in the same manner as the brackets 240 and has different shapes between the center portion corresponding to the positive moment region and the end portion corresponding to the negative moment region so as to achieve the effective use of the section and the easy connection with the column.

The interior of the girder 120, that is, the space enclosed by a bottom flange plate 120*a* and side web plates 120*b* is filled with concrete, and so as to maintain the shape during construction and to prevent the side web plates 120*b* from opening during the concrete casting, therefore, the interval maintaining members 160 are mounted on the girder 120. The interval maintaining members 160 are spaced apart from each other by a given distance over the whole length of the girder 120 in a direction perpendicular to the direction of the length of the girder 120 thereof in such a manner as to connect mounting plates 120*c* to each other. In the figures, the interval maintaining members 160 are formed of L-shaped steel (that is, angles), but they are not limited thereto. That is, they may be formed of members having the strength capable of preventing the opening of the side web plates 120*b* and an arbitrary sectional shape well known to the art, for example, ⊏-shaped steel (channels), Z-shaped steel and the like. On the other hand, the interval maintaining members 160 also serve as shear connectors inducing the composition of the slab concrete and the girder 120 as different materials.

The beams 130 are connected to the girder 120 in a perpendicular direction to the direction of the length of the girder 120. In the figures, two beams 130 are connected to one side of the girder 120, so that four beams 130 are connected to both sides of the girder 120, but the number of beams connected to the girder 120 is not limited thereto. Therefore, the number of beams connected to the girder 120 is determined upon the length of the girder 120.

As shown in FIG. 9*b*, the center portion of the girder 120 is composed of the bottom flange plate 120*a*, the side web plates 120*b*, and the mounting plates 120*c*. The side web plates 120*b* are extended upwardly perpendicularly from both ends of the bottom flange plate 120*a*, and the mounting plates 120*c* are extended outwardly from one ends of the side web plates 120*b* in such a manner as to be parallel to the bottom flange plate 120*a*.

As shown in FIGS. 9*c* and 9*d*, the connected portion of the girder 120 is composed of the connecting member 220 coupled to the center of the bottom flange plate 120*a*.

The connecting member 220 is composed of a center web plate 221 and top and bottom flange plates 222 and 223 formed on the top and bottom of the center web plate 221, thereby having a generally H-shaped section. The connecting member 220 is mounted on the end portion of the girder 120 in such a way that one side end portion of the bottom flange plate 223 thereof is connected to the top surface of the bottom flange plate 120*a* of the girder 120, while the other side end portion thereof is exposed to the outside.

Figure 10:
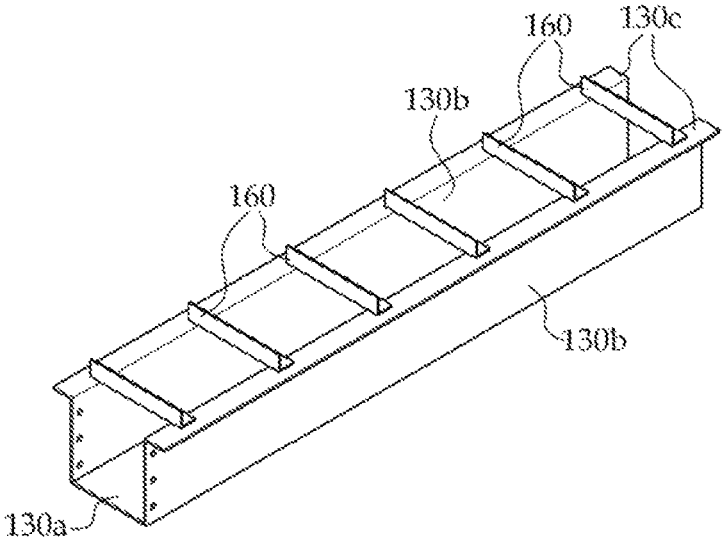
FIG. 10 is a perspective view showing a beam adopted in the steel frame structure according to the second embodiment of the present invention.

FIG. 10 is a perspective view showing the beam adopted in the steel frame structure according to the second embodiment of the present invention.

The beams 130 are made in the same manner as the girder 120 and have the same sectional shape as the center portion of the girder 120. That is, as shown in FIG. 10, each beam 130 includes a bottom flange plate 130*a*, side web plates 130*b*, and mounting plates 130*c*. The side web plates 130*b* are extended upwardly perpendicularly from both ends of the bottom flange plate 130*a*, and the mounting plates 130*c* are extended outwardly from one ends of the side web plates 130*b* in such a manner as to be parallel to the bottom flange plate 130*a*. In the same manner as the girder 120, further, the interval maintaining members 160 are spaced apart from each other over the whole length of the beam 130 to prevent the side web plates 130*b* from opening during the construction and the concrete casting.

Figure 11:
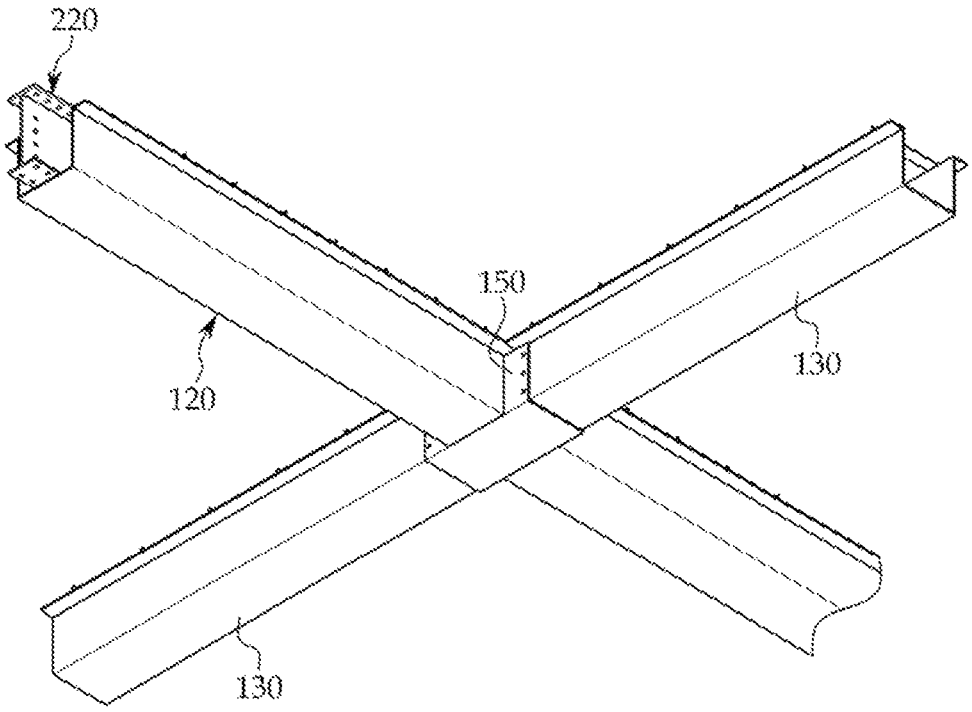
FIG. 11 is a bottom perspective view showing the connected portion between the girder and the beam in the steel frame structure according to the second embodiment of the present invention.

FIG. 11 is a bottom perspective view showing the connected portion between the girder and the beam in the steel frame structure according to the second embodiment of the present invention.

The beams 130 have the same beam depth as the girder 120 and are connected to the girder 120 by means of the beam connectors 150. Each beam connector 150 has both side plates 151 spaced apart from each other and a connecting plate 152 connecting the lower ends of the both side plates 151, thereby having a generally U-shaped section. The heights of the both side plates 151 are the same as the side web plates 120*b*, and the distance between the both side plates 151 is formed to insert the beam 130 thereinto. Accordingly, the beams 130 are inserted between the both side plates 151 of the beam connectors 150 and supported by means of the connecting plates 152. In this state, bolts are fastened to the beams 130, and as a result, the girder 120 and the beams 130 are connected to each other in simple and rigid manners.

On the other hand, the girder 120 has stiffeners 180 mounted between the side web plates 120*b* at the position connected to the beam connectors 150 on the same line as the both side plates 151 of the beam connectors 150, thereby preventing the buckling of the girder 120.

In the steel frame structure of the present invention, the bracket 240 connecting the column 110 and the girder 120 is formed of an H-shaped bracket 241 having a section of H-shaped beam or a CT (cut tees)-shaped bracket 242 having a section of CT-beam made by cutting the web portion of the H-shaped beam.

Figure 12A:
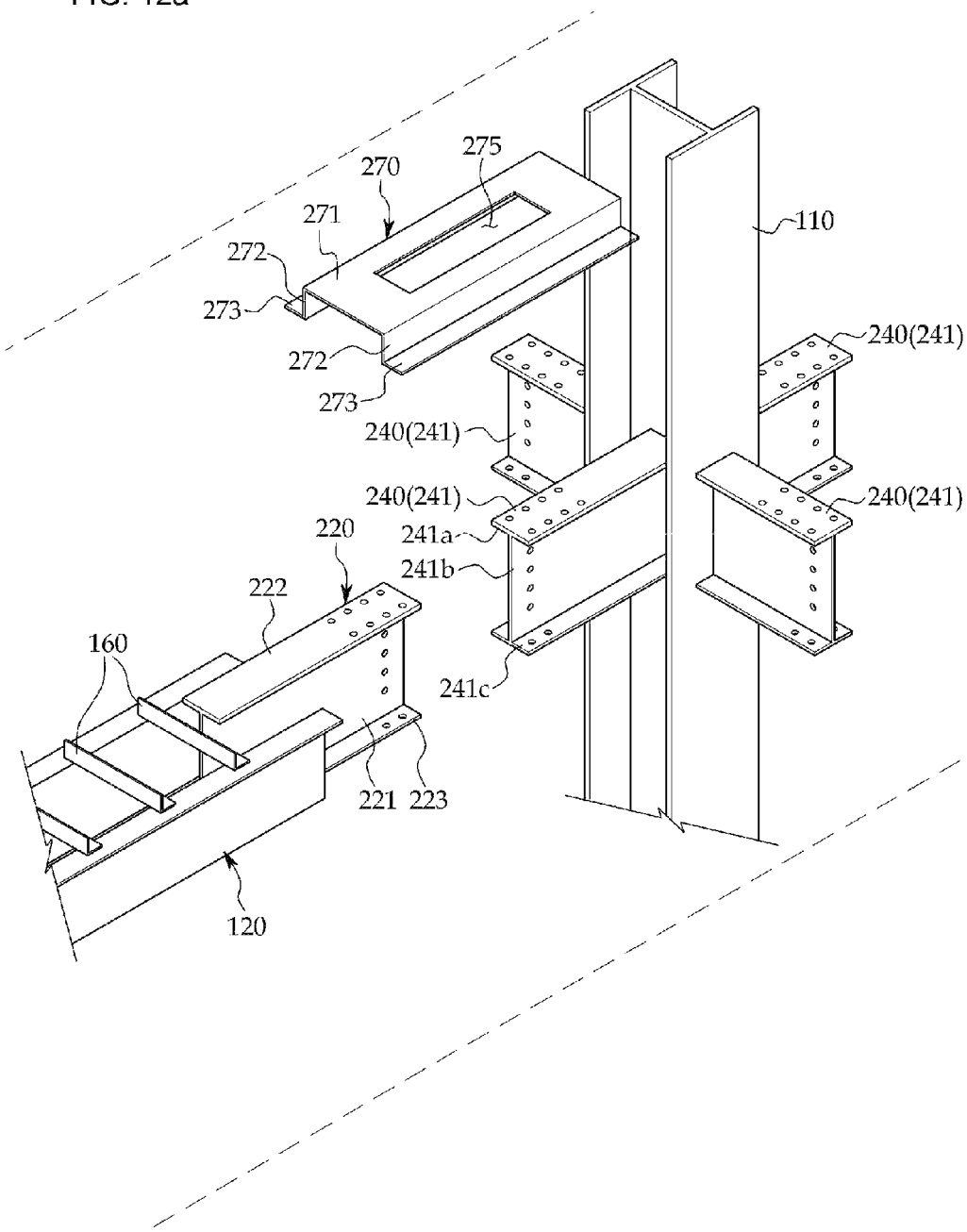
Figure 12B:
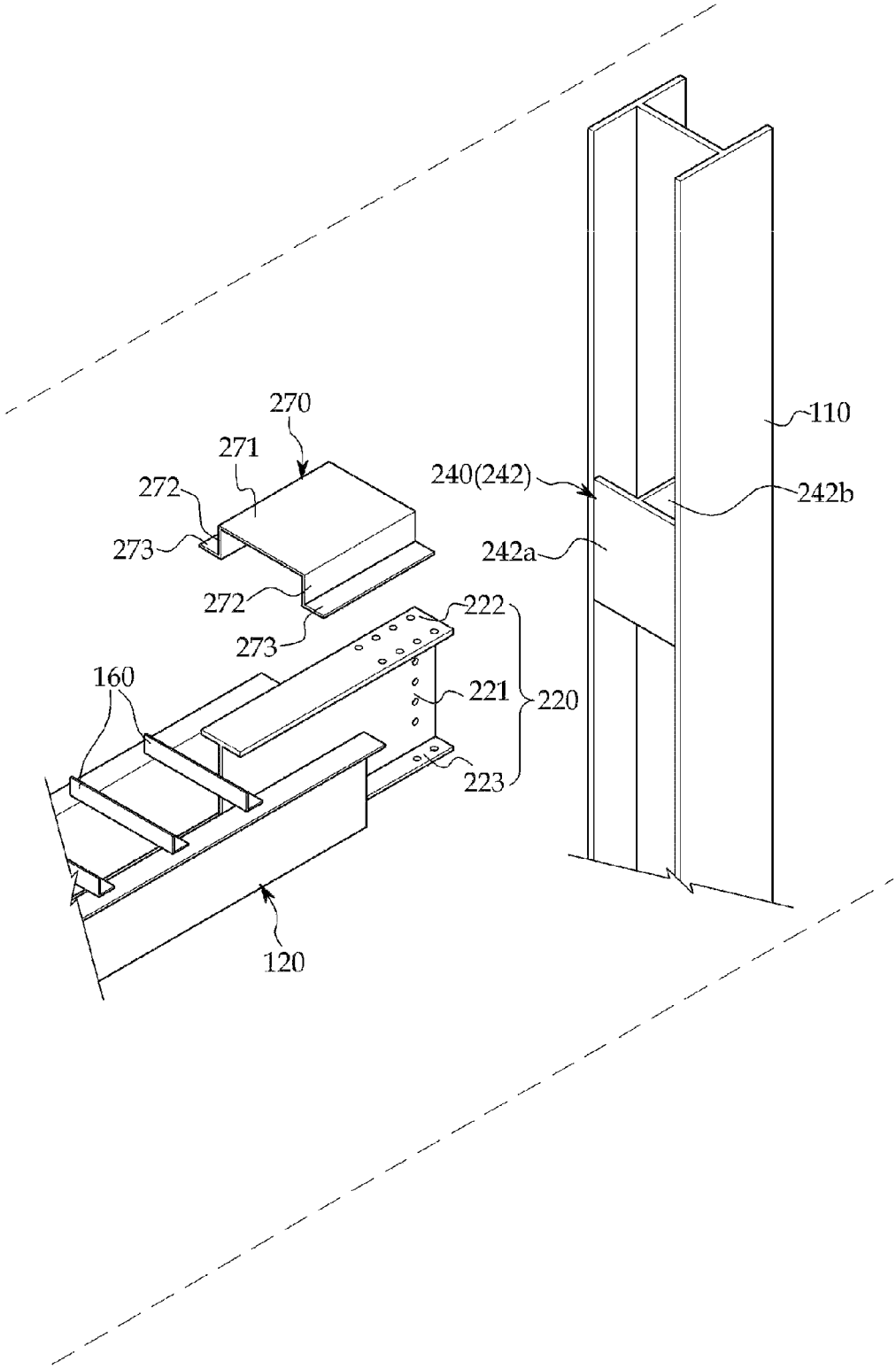
Figure 13A:
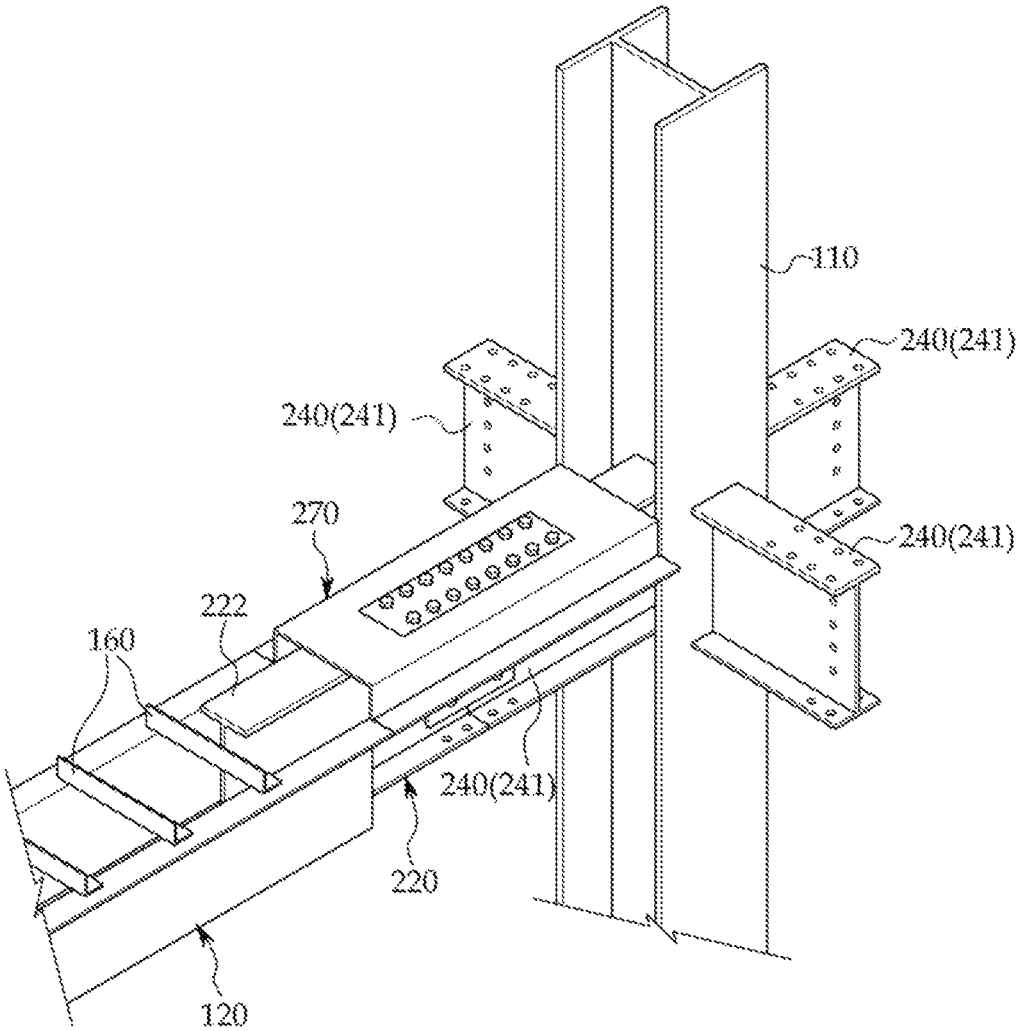
FIGS. 13*a* and 13*b* are perspective views showing the coupling states of FIGS. 12*a* and 12*b*.
Figure 13B:
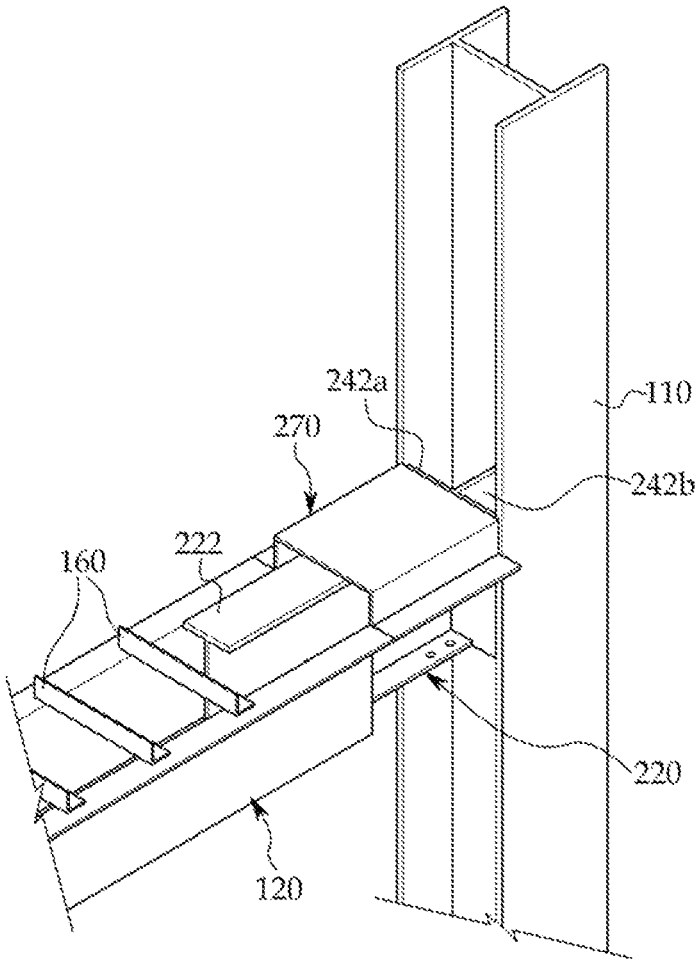

FIGS. 12*a* and 12*b* are exploded perspective views showing the connected portion between the bracket and the girder in the steel frame structure according to the second embodiment of the present invention, wherein FIG. 12*a* shows the H-shaped bracket 241 and FIG. 12*b* shows the CT-shaped bracket 242. FIGS. 13*a* and 13*b* are perspective views showing the coupling states of FIGS. 12*a* and 12*b*.

As shown in FIGS. 12*a* and 13*a*, the H-shaped bracket 241 has an asymmetric H-shaped or H-shaped section, which has the same shape as the girder 120. The H-shaped bracket 241 is composed of a top flange 241*a*, a web 241*b* formed vertically at the center of the top flange 241*a*, and a bottom flange 241*c* formed on the underside of the web 241*b* in such a manner as to be parallel to the top flange 241*a*. The H-shaped bracket 241 may be made by cutting the existing H-shaped beam or may be separately made.

The girder 120 and the H-shaped bracket 241 are rigidly connected to each other by means of cover plates. Through the cover plates, that is, the top flange plate 222 of the connecting member 220 is connected to the top flange plate 241*a* of the H-shaped bracket 241, the center web plate 221 of the connecting member 220 to the web 241*b* of the H-shaped bracket 241, and the bottom flange plate 223 of the connecting member 220 to the bottom plate 241*c* of the H-shaped bracket 140. At this time, the connection between the girder 120 and the H-shaped bracket 241 is performed by means of the connecting member 220, and therefore, through the openings formed on both sides of the web 221 of the connecting member 220 not connected to the girder 120, the center web plate 221 and the web 241*b* of the H-shaped bracket 241 are connected by means of the cover plate. Next, the covering member 270 is mounted over the connected portion between the girder 120 and the H-shaped bracket 241. According to the present invention, therefore, the connection process between the column 110 and the girder 120 can be performed without any interference of the side web plates 120*b* of the girder 120 forming the concrete casting space, in the same manner as the existing construction of the connection portion between the H-column and beam.

The mounting plates 120*c* of the girder 120 do not exist on the connected portion between the girder 120 and the H-shaped bracket 241. Since the surfaces for mounting the deck plate are not provided, accordingly, the covering member 270 is mounted over the connected portion between the girder 120 and the H-shaped bracket 241. The covering member 270 is composed of a top plate 271, side plates 172 extended downwardly perpendicularly from both ends of the top plate 271, and a bottom plate 273 extended outwardly horizontally from one ends of the side plates 272, and thus, the covering member 270 is covered over the connected portion between the girder 120 and the H-shaped bracket 241.

The top plate 271 is mounted over the top portion of the top flange plate 222 of the connecting member 220 and the top flange 241*a* of the H-shaped bracket 241 in such a manner as to be covered over the connected portion between the girder 120 and the H-shaped bracket 241, and the bottom plates 273 are connected to the mounting plates 120*c* of the girder 120 to supply the mounting surfaces of the deck plate, together with the mounting plates 120*c* of the girder 120.

Further, the covering member 270 has an opening 275 penetrated into the top plate 271 so as to avoid the interference caused by cover plates and bolts at the time of the connection between the top flange plate 222 of the girder 120 and the top flange 241*a* of the H-shaped bracket 241.

As shown in FIGS. 12*b* and 13*b*, the CT-shaped bracket 242 has a T-shaped section made by cutting the web plate of the H-shaped beam and is composed of a flange 242*a* and a web plate 242*b*. The CT-shaped bracket 242 may be made by cutting the existing H-shaped beam or may be separately made.

The web plate 242*b* of the CT-shaped bracket 242 is coupled to the column 110, and the flange 242*a* thereof is to the end portion of the girder 120.

The girder 120 and the CT-shaped bracket 242 are rigidly connected to each other by connecting the end portion of the connecting member 220 of the girder 120 to the flange 242*a* of the CT-shaped bracket 242. At this time, as mentioned above, openings are formed on the connected portion between the girder 120 and the CT-shaped bracket 242, and therefore, through the openings, the connection between the girder 120 and the CT-shaped bracket 242 is easily performed. According to the present invention, accordingly, the connection process between the column 110 and the girder 120 can be performed without any interference of the side web plates 120*b* of the girder 120 forming the concrete casting space, in the same manner as the existing construction of the connection portion between the H-column and beam.

After the connection, the covering member 270 is mounted over the connected portion between the girder 120 and the CT-shaped bracket 242.

The mounting plates 120*c* of the girder 120 do not exist on the connected portion between the girder 120 and the CT-shaped bracket 242. Since the surfaces for mounting the deck plate are not provided, accordingly, the covering member 270 is mounted on the connected portion between the girder 120 and the CT-shaped bracket 242. The covering member 270 is composed of the top plate 271, the side plates 172 extended downwardly perpendicularly from both ends of the top plate 271, and the bottom plate 273 extended outwardly horizontally from one ends of the side plates 272, and thus, the covering member 270 is covered over the connected portion between the girder 120 and the CT-shaped bracket 242.

The top plate 271 is mounted over the top portions of the top flange plate 222 of the girder 120 and the flange 242*a* of the CT-shaped bracket 242 in such a manner as to be covered over the connected portion between the girder 120 and the CT-shaped bracket 242, and the bottom plates 273 are connected to the mounting plates 120*c* of the girder 120 to supply the mounting surfaces of the deck plate, together with the mounting plates 120*c* of the girder 120.

FIGS. 14*a* to 14*d* are perspective views showing a construction method of the steel frame structure according to the second embodiment of the present invention.

Under the above-mentioned configuration of the steel frame structure according to the second embodiment of the present invention, the components needed for the connected portion between the bracket 240 and the girder 120 are previously made in a plant and then carried and constructed just by means of bolt connection in a construction site, in the same manner as the existing steel frame structure construction method.

In more detail, the columns 110, the girder 120, the beams 130, the brackets 240, the beam connectors 150, the interval maintaining members 160, and the covering members 270 are made in a plant. Next, the brackets 240 are connected to the columns 110 by means of welding, and the interval maintaining members 160, the beam connectors 150 and the stiffeners 180 are to the girder 120 by means of welding.

After that, they are delivered to the construction site and assembled to each other. That is, the columns 110 to which the brackets 240 are connected are erected (see FIG. 14*a*), and the girder 120 is connected between the columns 110 through the brackets 240 (see FIG. 14*b*). At this time, the covering members 270 are mounted over the girder 120 and the brackets 240. Lastly, the beams 130 are connected to the girder 120 by means of the beam connectors 150 (see FIG. 14*c*).

Figure 14A:
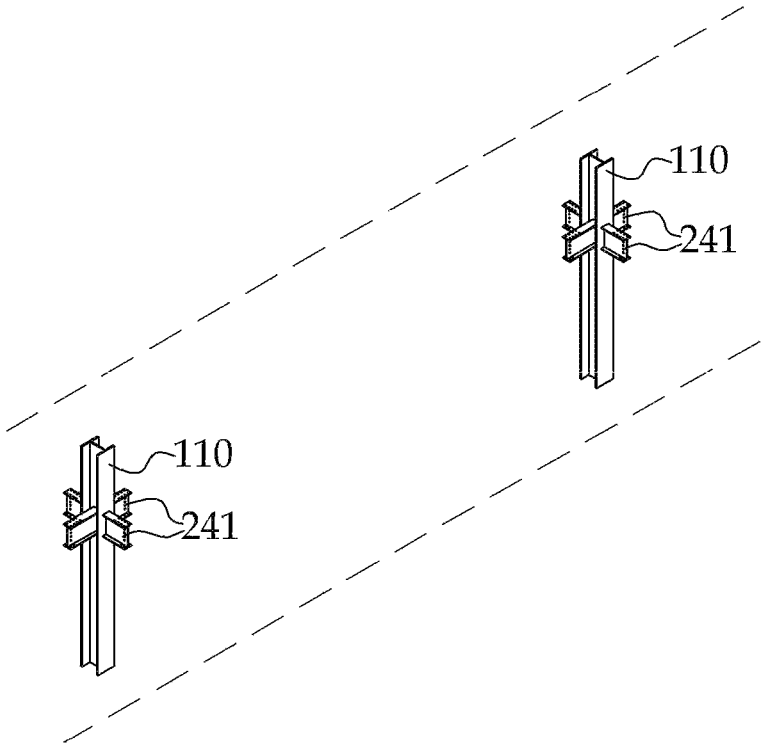
FIGS. 14*a* to 14*d* are perspective views showing a construction method of the steel frame structure according to the second embodiment of the present invention.
Figure 14B:
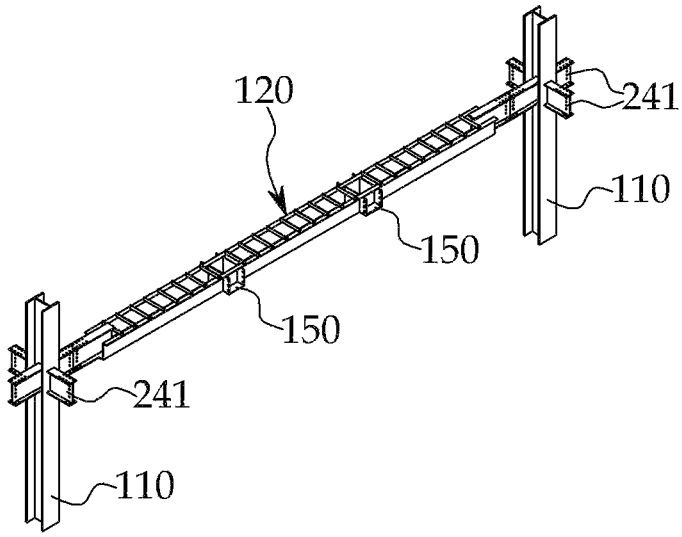
Figure 14C:
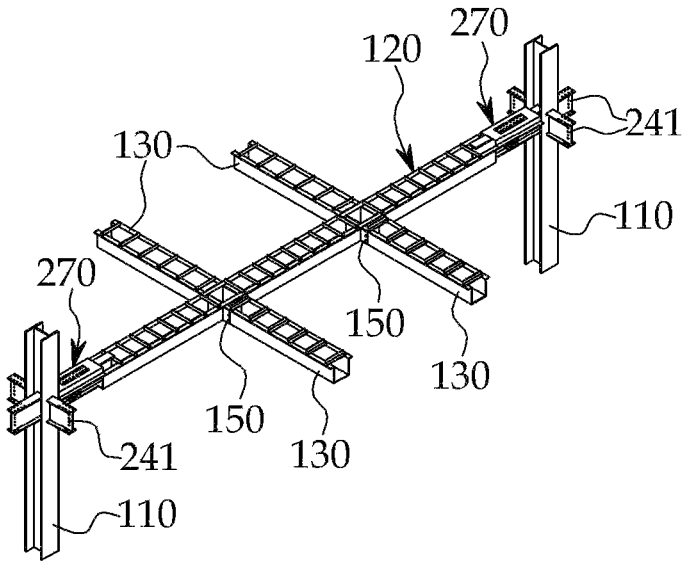
Figure 14D:
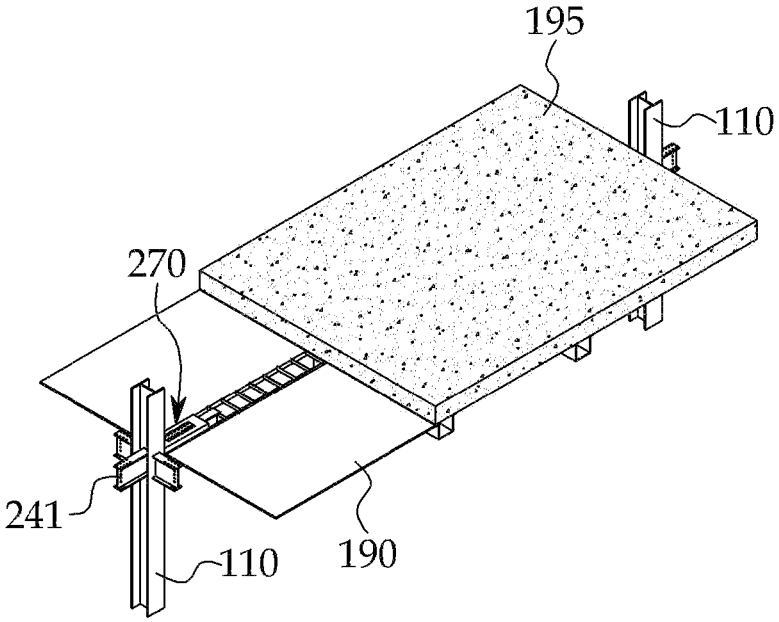

On the girder 120 and the beams 130 of the steel frame structure formed with the above-mentioned configuration, a deck plate 190 is mounted to cast slab concrete 195 thereon (see FIG. 14*d*). At the time of the slab concrete casting, the concrete is filled into the girder 120 and the brackets 240. Accordingly, the girder 120 and the beams 130 according to the present invention become the composite girder and beam made by integrating the steel and the concrete.

On the other hand, the columns 110 are formed of steel columns in the second embodiment of the present invention, but they may be formed of steel framed reinforced concrete columns made by coating the steel column with concrete. In this case, the connecting method of the columns 110 and the girder 120 are the same as the steel columns, but before the slab concrete casting, column bars are arranged. Next, the column molds are formed, and then, the column concrete casting is performed together with the slab concrete casting.

According to the present invention, the U-shaped composite girder and beams can be simply made just by bending single steel plates at a room temperature, thereby reducing the manufacturing costs. Further, the construction of the connected portions between columns and girder and between the girder and beams can be made in a simple manner and the structural stability can be ensured. Especially, the construction of the connected portion between the column and the girder can be performed without having any interference of the side plates for the concrete casting in the interior of the girder.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

The invention claimed is:

1. A steel frame structure having columns, a girder connected between the columns, and beams connected to the girder, the steel frame structure comprising:

brackets connected to each column between the column and the girder, each bracket having a top flange;

the girder having a center portion, end portions, mounting plates and a generally U-shaped section, connecting members connecting the brackets to the girder, each of the connecting members having end portions and a top flange plate having a top portion, one of the end portions of each of the connecting members extending from one of the ends of the girder and the other of the end portions of the connecting members connected to one of the brackets, each connecting member having a center web plate and top and bottom flange plates formed on a top and a bottom of the center web plate, interval maintaining members spaced apart from each other by a given distance over a whole length of a top surface of the mounting plates, and beam connectors connecting the beams to the girder;

each of the beams having a bottom flange plate, side web plates extending upwardly perpendicularly from ends of the bottom flange plate, and mounting plates extended outwardly from the side web plates parallel to the bottom flange plate, each of the beams connected to the girder through the beam connectors and further having interval maintaining members spaced apart from each other by a given distance over a whole length of a top surface of the beam mounting plates; and covering members each having a top plate covered over the top portion of the top flange plate of the connecting members and the top flange of the brackets, side plates extending downwardly perpendicularly from the top plate, and at least one bottom plate extending outwardly horizontally from the side plates parallel to the mounting plates of the girder, whereby concrete is filled into the girder and the beams.

2. The steel frame structure according to claim 1, wherein the center portion of the girder comprises a bottom flange plate, side web plates extending upwardly perpendicularly from the bottom flange plate, and mounting plates extending outwardly from the girder side web plates parallel to the girder bottom flange plate.

3. The steel frame structure according to claim 1, wherein each bracket comprises a web extending vertically from a center of the bracket top flange, and a bottom flange formed on an underside of the web parallel to the bracket top flange.

4. The steel frame structure according to claim 3, wherein the covering member has an opening through the top plate.

5. The steel frame structure according to claim 1, wherein the interval maintaining members comprise angles or channels.

6. The steel frame structure according to claim 1, wherein each of the beam connectors comprises side plates spaced apart from each other and a connecting plate connecting lower ends of the side plates, each of the beam connector side plates having a height, and each of the beam side web plates having a height, the heights of the side plates being the same as the heights of the side web plates, and the girder at the position connected to the beam connectors comprises stiffeners mounted between the side web plates.

* * * * *